US008596926B2

(12) United States Patent
Heselden

(10) Patent No.: US 8,596,926 B2
(45) Date of Patent: Dec. 3, 2013

(54) GABIONS

(75) Inventor: James Heselden, Leeds (GB)

(73) Assignee: Hesco Bastion Limited, Leeds, Yorkshire (GB)

( * ) Notice: Subject to any disclaimer, the term of this patent is extended or adjusted under 35 U.S.C. 154(b) by 315 days.

(21) Appl. No.: 12/595,793

(22) PCT Filed: Jul. 15, 2008

(86) PCT No.: PCT/GB2008/050574
§ 371 (c)(1),
(2), (4) Date: Apr. 20, 2010

(87) PCT Pub. No.: WO2009/019500
PCT Pub. Date: Feb. 12, 2009

(65) Prior Publication Data

US 2010/0193512 A1 Aug. 5, 2010

(30) Foreign Application Priority Data

Aug. 6, 2007 (GB) ..... 07151574.7

(51) Int. Cl.
*B65D 6/00* (2006.01)

(52) U.S. Cl.
USPC ..... 405/284; 405/15

(58) Field of Classification Search
USPC ..... 405/15, 16, 21, 30, 32, 284, 287, 287.1
See application file for complete search history.

(56) References Cited

U.S. PATENT DOCUMENTS

| | | | |
|---|---|---|---|
| 4,483,540 | A | 11/1984 | Bordien et al. |
| 4,483,640 | A | 11/1984 | Berger et al. |
| 4,530,622 | A | 7/1985 | Mercer |
| 5,050,765 | A | 9/1991 | Roser et al. |
| 5,176,469 | A | 1/1993 | Alsop |
| 5,333,970 | A | 8/1994 | Heselden |
| 5,472,297 | A | 12/1995 | Heselden |
| 5,482,408 | A | 1/1996 | Lunardi |

(Continued)

FOREIGN PATENT DOCUMENTS

| | | | |
|---|---|---|---|
| CA | 2086588 | A1 | 7/1994 |
| CA | 2108964 | A | 4/1995 |

(Continued)

OTHER PUBLICATIONS

International Preliminary Report on Patentability issued in connection with PCT/GB2008/050574 on Nov. 5, 2009.

(Continued)

*Primary Examiner* — Benjamin Fiorello
(74) *Attorney, Agent, or Firm* — Ping Wang; Andrews Kurth LLP

(57) ABSTRACT

The present invention relates to a gabion comprising at least one individual compartment for receiving, a fill material, the each individual compartment of the gabion being bounded by at least one wall, the wall material forming at least one closed panel around the each individual compartment effective for retaining the fill material, the wall material having sufficient flexibility to allow the gabion to be folded and/or rolled in a first pre-deployment configuration, wherein the pre-deployed gabion is restrained in its first configuration by a form of restraining means, the wall material having sufficient resilience such that when the gabion is released from its restraining means, it tends to unfold and/or unroll from its first configuration towards or to a second deployment configuration.

30 Claims, 4 Drawing Sheets

(56) References Cited

U.S. PATENT DOCUMENTS

| | | | | |
|---|---|---|---|---|
| 5,638,938 | A | 6/1997 | Lazzarotti et al. | |
| 5,647,695 | A | 7/1997 | Hilfiker et al. | |
| 5,791,020 | A * | 8/1998 | Eichstadt | 24/16 R |
| 6,692,188 | B1 * | 2/2004 | Walker et al. | 405/115 |
| 2003/0035690 | A1 | 2/2003 | Earl | |
| 2005/0135883 | A1 * | 6/2005 | McGinn | 405/302.6 |
| 2006/0120820 | A1 | 6/2006 | Nyeboer | |

FOREIGN PATENT DOCUMENTS

| | | | |
|---|---|---|---|
| DE | 8502951 | U1 | 7/1985 |
| DE | 20014332 | U1 | 1/2001 |
| EP | 0816572 | A2 | 1/1998 |
| EP | 1186719 | A2 | 3/2002 |
| EP | 1498552 | A1 | 1/2005 |
| EP | 1505210 | A1 | 2/2005 |
| GB | 2229204 | A | 9/1990 |
| GB | 2268463 | A | 1/1994 |
| GB | 2293190 | A | 3/1996 |
| GB | 2294453 | A | 5/1996 |
| GB | 200040810 | A1 | 7/2000 |
| GB | 2423107 | A | 8/2006 |
| JP | 57 146835 | A | 9/1982 |
| JP | 58 106020 | A | 6/1983 |
| JP | 07109718 | A | 4/1995 |
| JP | 09316849 | A | 12/1997 |
| JP | 2004169404 | A | 6/2004 |
| JP | 2005 048459 | A | 2/2005 |
| JP | 2005146661 | A | 6/2005 |
| WO | 9012160 | A1 | 10/1990 |
| WO | 2005080691 | A | 9/2005 |
| WO | 2007/060475 | A | 5/2007 |

OTHER PUBLICATIONS

United Kingdom Search Report, GB Application No. 0619038.3.

International Search Report, International Patent Application No. PCT/GB2006/050256, filed Aug. 23, 2006.

International Search Report, Written Opinion of the International Searching Authority, and International Preliminary Report on Patentability of International Patent Application No. PCT/GB2006/050257, filed Aug. 23, 2006.

United Kingdom Patent Office Search Report, Great Britain Patent Application No. GB0616710.0, filed Aug. 23, 2006.

* cited by examiner

GABIONS

FIELD

The present invention is concerned with gabions, particularly with gabions which can be rapidly deployed in time-critical circumstances such as in disaster relief or during military operations.

BACKGROUND

Gabions are temporary or semi-permanent fortification structures which are used to protect military or civilian installations from weapons assault or from elemental forces, such as flood waters, lava flows, avalanches, slope erosion, soil instability and the like.

WO-A-90/12160 discloses wire mesh cage structures useful as gabions. The cage structure is made up of pivotally interconnected open mesh work frames which are connected together under factory conditions so that the cage can fold concertina-wise to take a flattened form for transportation to site, where it can be erected to take an open multi-compartmental form for filling with a suitable fill material, such as sand, soil, earth or rocks.

WO-A-00/40810 also concerns a multi-compartmental gabion which folds concertina-wise for transportation, and which comprises side walls extending along the length of the multi-compartmental gabion, the side walls being connected at spaced intervals along the length of the gabion by partition walls which are formed from two releasably connected sections, which after use of the gabion can, be released, and the gabion unzipped for recovery purposes.

WO2007060475 discloses a gabion comprising side walls connected together at spaced intervals by partition walls, the side walls comprising at least one substantially closed side wall element panel, which acts in use of the gabion to prevent a gabion fill material from falling through the side wall, the said action of the substantially closed side wall element panel being effective without the aid of a gabion lining material.

All of the aforesaid gabions suffer from one or more of the following disadvantages: they are cumbersome and/or unwieldy to store and/or to erect; they require an inconvenient multiplicity of component parts to effect satisfactory erection, storage and/or deployment; they comprise component parts which are liable to degradation, particularly in harsh environmental conditions; they are liable to leak fill material; they require expensive and/or heavy materials.

Certain commercial gabions also have some disadvantages with respect to construction and longevity. For example, such gabions frequently comprise a wire mesh cage structure lined with a geotextile material, the lining adding to the cost and complexity of the gabion structure, and constituting a significant limitation on the functionality of the gabion after deployment over a long period of time. Particularly in harsh environmental conditions (intense sunlight, wind, rain, snow, sand or salt spray, or a combination of any two or more of these), the geotextile material tends to degrade and this can weaken the functionality of the gabion by, for example, the occurrence of rips, tears or holes in the liner, through which the gabion fill material can fall.

Accordingly, there is a need for an improved gabion. There is also a need for an improved multi-compartmental gabion.

BRIEF DESCRIPTION OF DRAWINGS

The invention will now be more particularly described with reference to the following drawings, in which.

DETAILED DESCRIPTION

According to the present invention there is provided a multi-compartmental gabion comprising at least two individual compartments for receiving, in use of the gabion, a fill material, each individual compartment of the gabion being bounded by at least one wall, the wall material forming at least one closed panel around each individual compartment effective for retaining the fill material in each compartment in use of the gabion, the wall material having sufficient flexibility to allow the gabion to be folded and/or rolled in a first pre-deployment configuration in which the pre-deployed gabion is restrained in its first configuration by a form of restraining means, the wall material having sufficient resilience such that when the gabion is released from its restraining means it tends to unfold and/or unroll from its first configuration towards or to a second deployment configuration in which the gabion is erected and able to receive in its individual compartments the fill material, the wall material having sufficient rigidity such that the gabion is self supporting in its second configuration.

Figure 5:
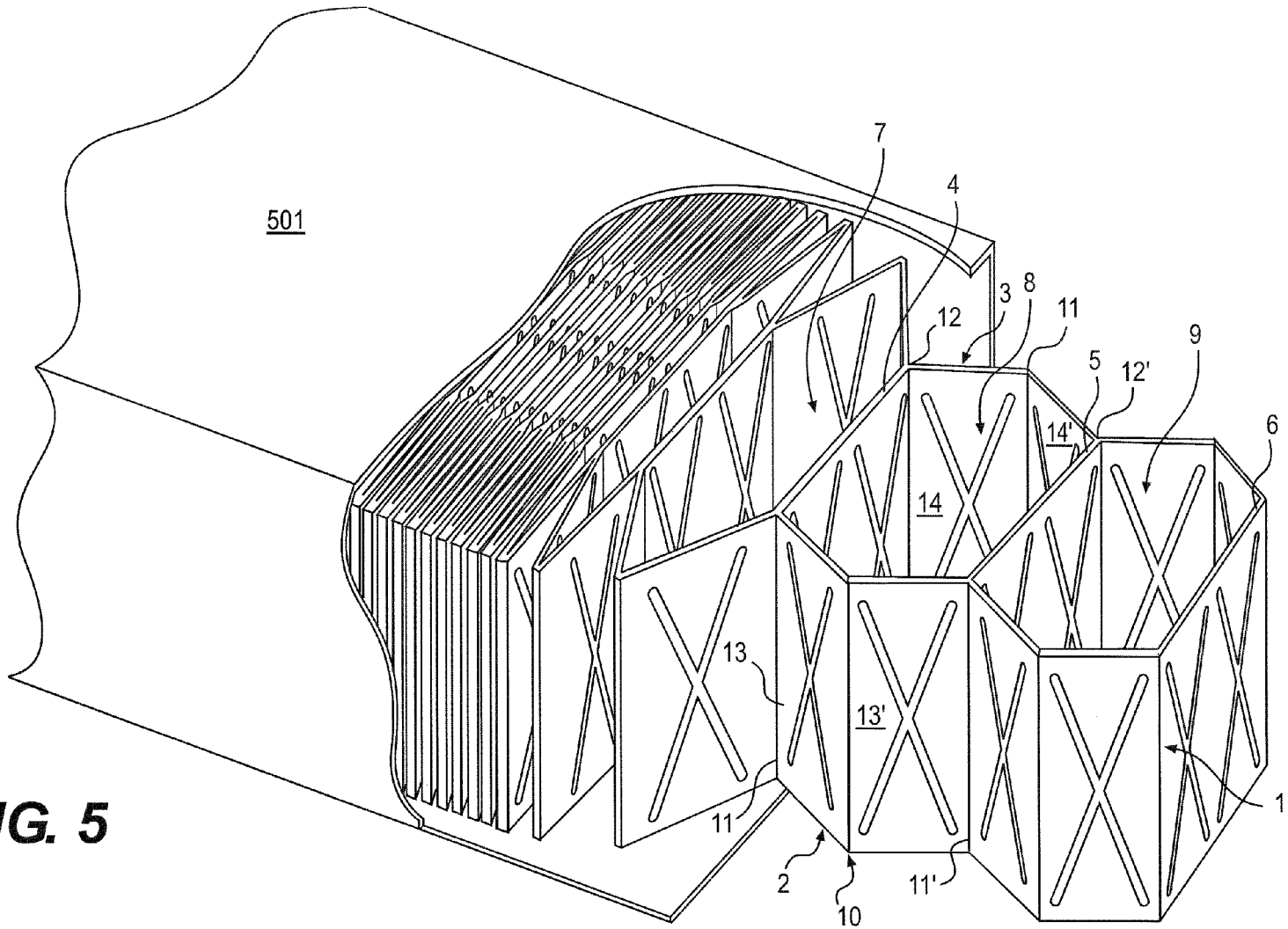
FIG. 5 shows a pre-deployed gabion in accordance with the invention restrained in its first configuration by a form of restraining means 501.

The restraining means 501 may suitably comprise a form of clip, fastener, tie or container, as shown in FIG. 5. In one embodiment of the invention, the gabion is folded concertina-fashion and compressed to minimise the gabion length in its first configuration. The folded gabion can be placed in a storage container for shipping and held in its compressed configuration by suitable restraining means (lugs on the walls of the storage container for example) or simply by the closure of the storage container, the doors of which may themselves constitute suitable restraining means.

The gabion of the invention preferably has a length $I_1$ in its first configuration, and a length $I_2$ in its second configuration, $I_1$ being substantially shorter than $I_2$. The axial strain in compression $\epsilon$ may be defined as $(I_1-I_2)/I_2$. Preferably $\epsilon<-0.5$, more preferably $<-0.6$, yet more preferably $<-0.7$, still more preferably $<-0.8$ and most preferably $<-0.9$.

In constraining the gabion in its first configuration a load P is applied to the gabion which has a cross sectional area A. The axial stress in compression a may be defined as P/A.

The stress-strain curve of the gabion when compressed from its second to its first configuration and its resilience modulus, the strain energy density at yield, can be measured. The modulus of resilience $U_r$ and be defined as $0.5\sigma_y\epsilon_y$ where $\sigma_y$ and $\epsilon_y$ are the axial stress and strain respectively at yield. The modulus is negative in compression. Preferably $U_r<-0.25$, more preferably $<-0.3$, still more preferably $<-0.35$, yet more preferably $<-0.4$ and most preferably $<-0.45$. $U_r$ may be considerably below −0.5, for example below −1, below −2, below −5 or even below −10 or −50 or −100.

Preferably the length of the gabion in its first configuration is less than about 50%, more preferably less than about 40%, still more preferably less than about 30%, yet more preferably less than about 20% and most preferably less than about 10% of its length in its second configuration.

Each individual compartment may be the same or a different shape in cross section. Preferably, each individual compartment is the same shape in cross section. When each individual compartment is circular in cross section, or oval or ovoid for example then a single wall bounds the compartment. When each individual compartment is triangular, square, rectangular, pentagonal, hexagonal, octagonal or other polygonal or irregular shape for example then a multiplicity of walls bounds the compartment.

Preferably each compartment is bounded by a single section of wall material, joined to itself to enclose the compartment and folded or curved to create the wall or walls of the compartment. However, it is also possible for each compartment to be bounded by multiple sections of wall material joined together in a suitable manner.

Each individual compartment of the gabion is joined in a suitable manner to at least one neighboring compartment. When the gabion comprises three or more compartments then the middle compartment(s) will generally be joined to at least two neighboring compartments, one at each end. Often the gabion will comprise in its erected configuration a row of compartments in a line along the length of the gabion. The line may be straight or curved or irregular in deployment, to suit the intended use. However it is also contemplated to provide a multiplicity of compartments across the width of the gabion. In this case each compartment along the width of the gabion will generally be joined to at least one neighboring width-wise compartment. Thus, as well as single line multi-compartmental gabions, it is also contemplated within the scope of this invention to provide a multi-compartmental cellular structure in, for example, a honeycomb configuration.

The gabion wall material section bay be joined to itself to circumscribe a compartment and joined to another section of another compartment to join the compartments together by any suitable joining means such as gluing, stapling, clipping, sewing, fastening (e.g. with hook and eye type fasteners such as Velcro™).

Thus, according to the present invention there is provided a gabion comprising side walls connected together at spaced intervals by partition walls, the side walls comprising at least one substantially closed side wall element panel, wherein the each substantially closed side wall element is manufactured of a material having sufficient flexibility to allow the gabion to be folded and/or rolled in a first pre-deployment configuration in which the pre-deployed gabion is restrained in its first configuration by a form of restraining means, the wall material having sufficient resilience such that when the gabion is released from its restraining means it tends to unfold and/or unroll from its first configuration towards or to a second deployment configuration in which the gabion is erected and able to receive in its individual compartments the fill material, the wall material having sufficient rigidity such that the gabion is self supporting in its second configuration.

The substantially closed panel acts in use of the gabion to prevent a gabion fill material (sand, earth, soil, stones or fines, for example) from falling through the side wall without the aid of a gabion lining material.

Preferably, the rigidity of the wall material is sufficient to prevent excessive bulging of the side wall element panel when the gabion is filled with a fill material, and to prevent collapsing of the wall when the fill material is being introduced.

Other desirable characteristics of the wall material include, either alone or in combination, durability, toughness, tear resistance, scratch and erosion resistance, corrosion resistance, thermal stability, ultraviolet stability, low density, low cost and recyclability.

Preferably the wall material comprises a laminate structure. Preferably at least one layer of the laminate comprises a tear-resistant flexible material. Preferably at least one other layer comprises a material having a cellular structure.

The sheet material may conveniently be selected from any suitable material having the necessary mechanical properties. Preferred materials which are found to have excellent tear resistance, flexibility and resilience include polymeric sheets produced by hot compaction of melt spun fibres. Such sheets may be derived for example from the polyolefin plaques described in WO9815397 and the monoliths described in WO9215440.

Other suitable wall materials include polymeric sheets of the type described in WO2004103673. This disclosure is concerned with a process for the production of a polymeric article comprising the steps of: (a) forming a ply having successive layers, namely a first layer made up of strands of an oriented polymeric material; (ii) a second layer of a polymeric material; (iii) a third layer made up of strands of an oriented polymeric material, wherein the second layer has a lower peak melting temperature than that of the first and third layers; (b) subjecting the ply to conditions of time, temperature and pressure sufficient to melt a proportion of the first layer, to melt the second layer entirely, and to melt a proportion of the third layer; and to compact the ply; and (c) cooling the compacted ply. The resultant articles are said to have good mechanical properties yet may be made at lower compaction temperatures than articles not employing the second layer, leading to a more controllable manufacturing process.

Other suitable wall materials include monolithic articles of the type described in WO03045660. This disclosure is concerned with a process for production of a monolithic article from a web of fibres of oriented polypropylene homopolymer or copolymer having a weight average molecular weight (Mw) of at least 250,000 and includes the steps of subjecting the web to elevated temperature and pressure sufficient to melt a proportion of the polymer and compact it, and thereby yielding an oriented phase and a matrix phase, and effecting a heat treatment selected from (i) subjecting the compacted web to a retarded rate of cooling down to a lower temperature at or below the temperature a which the recrystallization of the matrix is complete; and (ii) annealing the compacted web at an annealing temperature within 15° C. of the temperature at which the matrix phase is completely melted. The resultant articles are said to have good stiffness and strength, and acceptable ductility, yet corresponding articles made with polypropylene of lower Mw are brittle.

Other suitable wall materials include amorphous polymer articles of the type described in WO02102568. This disclosure is concerned with an amorphous polymer article produced by hot compaction and a method of producing the same. The article is heated to a temperature and maintained at a pressure sufficient to cause softening of the polymer strands to sufficient a degree to allow bonding to adjacent fibres to take place without actually transforming the polymer into a liquid state.

Other suitable wall materials include composite materials of the type described in WO9726025. This disclosure is concerned with a composite material comprising an inorganic filler material and an oriented fibrous polymeric material characterized in that the fibrous material has areas of adjacent fibres fused together to form a network or continuous matrix while retaining oriented fibrous structure in the composite.

Other suitable wall materials include composite materials of the type described in WO02090082. This disclosure is concerned with a process for the production of an article from a woven fabric of melt spun and drawn fibres or tapes of oriented polypropylene homopolymer or copolymer, comprising subjecting the woven fabric of melt spun and drawn fibres or tapes to elevated temperature and pressure sufficient to melt a proportion of the polymer, characterized in that the draw ratio of said melt spun and drawn fibres or tapes is at least 7:1.

When the wall material comprises a polymeric material, the material may be stabilized with respect to ultraviolet radiation e.g. by the addition of fillers and/or UV absorbers to prevent them becoming discolored and/or brittle upon extended exposure to sunlight.

In certain circumstances, it may be desirable to add colored fillers to the plastics material to provide a desired aesthetic effect. In one aspect of the invention, more than one color filler is added to the plastics material and partially blended therewith to create a non-homogeneous colored/marbled effect. For example; green and brown; white and grey; or yellow and brown color fillers could be added to provide camouflage for vegetated, snowy or desert environments, respectively. Because such colors are integral with the sheet material (i.e. not a surface decoration), they are less susceptible to removal by erosion (e.g. by sand in a sandstorm).

It is desirable to make the sheet material as thin as possible to reduce the folded volume of the gabion when being stored or transported. A major advantage of using thin-sheet materials is weight saving, which reduces transportation costs and facilitates manual deployment/rearrangement of the gabion. However, because of the requirement to provide both rigidity in the erected gabion and resilience in its folded or rolled configuration it may be desirable to laminate the sheet material to another functional material for providing rigidity and/or resilience. Suitable functional materials include steel, aluminum, titanium, other metals, alloys, plastics or certain natural materials, or combinations of two or more thereof. Where a metal is used, it is preferably either treated for corrosion resistance, e.g. by galvanization and/or painting or is inherently corrosion resistant, e.g. a stainless steel.

Where the functional material is a plastics material it may be polyethylene (PE), polypropylene (PP) or a composite such as glass fibre reinforced polymer (GFRP). The molecular weight of the chosen plastic can be selected to suit the application (e.g. LDPE, HDPE, LDPP, HDPP).

One preferred form of functional material has a cellular structure, such as a honeycomb structure for example. Such a structure adds strength and rigidity to the laminate and also provides excellent resilience in folding or rolling.

Figure 6:
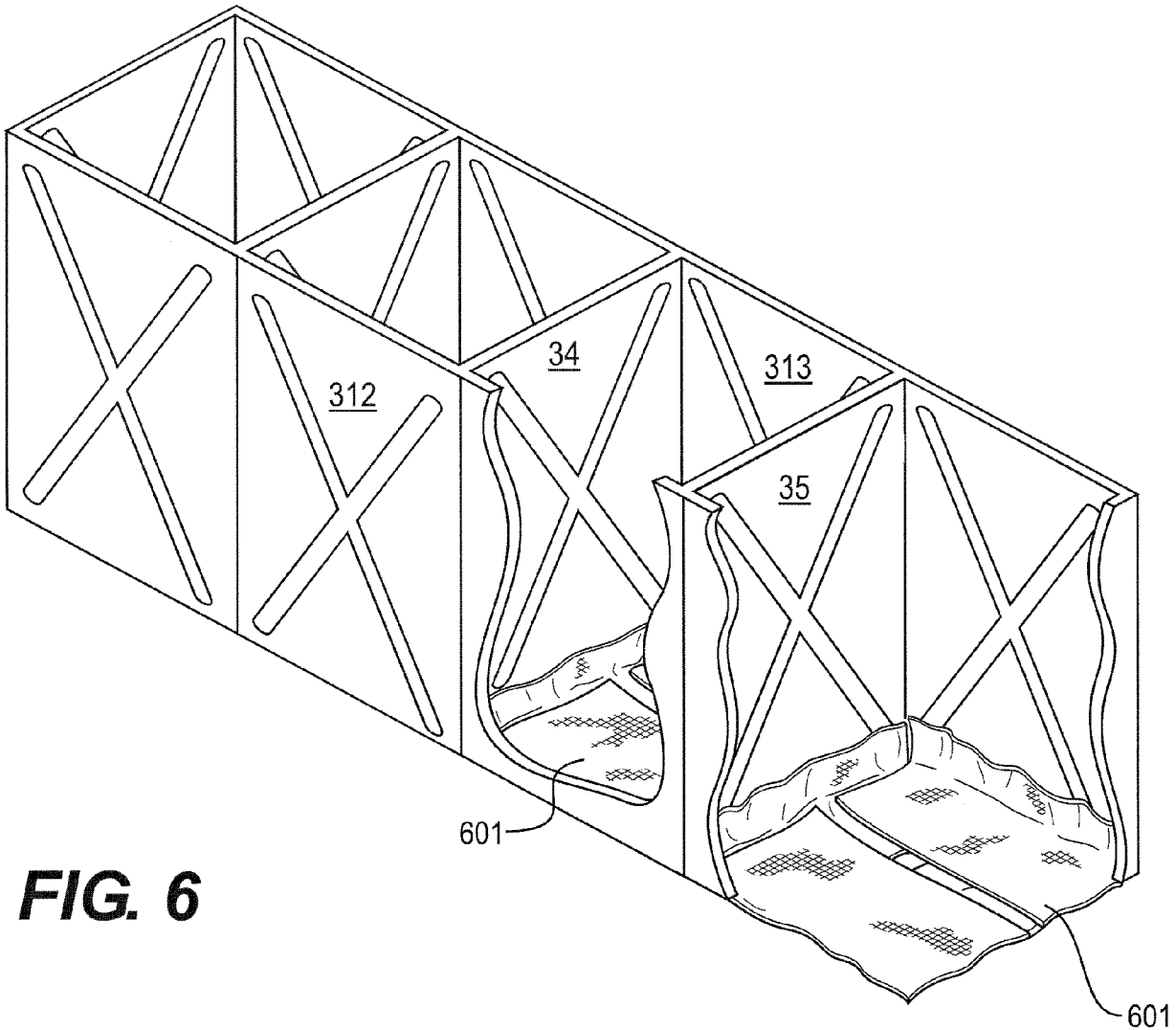
FIG. 6 shows a cut-away perspective view of a gabion in accordance with the invention having a skirt material 601 provided around the bottom edge of an individual compartment of the gabion.

A skirt material 601 may also be provide around the bottom edge of each individual compartment, the skirt material being affixed to the wall material and overlying the bottom edge of the compartment so that when the gabion is erected the skirt material overhang portion lies on the ground inside the compartment and the fill material then covers the skirt, as shown in FIG. 6. The provision of the skirt prevents fill material egress at the bottom of the gabion. Suitable skirt materials include woven and non-woven fabrics and plastics, and geotextile materials.

The partition walls may likewise be formed from closed panels, and may be formed of the same material as the wall material. However, the partition walls may also be formed from an open mesh material, for example.

Deployment of the gabion of the invention will generally be effected by transporting the folded or rolled gabion to a deployment site, releasing the folded or rolled gabion from its form of restraining means, unfolding or unrolling the gabion (at least partially assisted by the resilience of the wall material, causing the gabion to "spring" into or towards its erected configuration) and filling each individual compartment of the gabion with a fill material. Generally the fill material will be dictated at least partly by the availability of suitable materials at the deployment site. Suitable fill materials include, but are not limited to, sand, earth, soil, stones, rocks, rubble, concrete, debris, snow, ice and combinations of two or more thereof.

A side wall section preferably comprises a single side wall element panel, or two side wall element panels. However, a side wall section, a plurality of side wall sections, or each side wall section may, if desired comprise more than two side wall element panels. In this case resilient folds are preferably provided between each side wall element panel.

The concertina-wise folding of the gabion may be effected by the side wall sections folding in towards the central longitudinal axis of the gabion, or by the side wall sections folding out away from the central longitudinal central axis of the gabion. The former manner will generally be preferable as the resulting folded gabion will have a relatively smaller cross-sectional surface area in a plane orthogonal to the central longitudinal axis of the gabion.

The gabion of the invention may comprise substantially closed side wall element panels with resilient folds therebetween which are folded or rolled together under factory conditions so that the gabion can take a flattened form for transportation to site where it can be erected to take a form in which panels thereof define side, partition and end walls and an open top through which the compartments of the gabion may be filled. Preferably, under factory conditions said panels define side, partition and end walls and are relatively foldable to lie face to face in the flattened form for transportation to site and can be relatively unfolded to bring the gabion to the erected condition without the requirement for any further connection of the side, partition or end walls on site.

In preferred embodiments of the invention, the side walls of the gabion each comprise a plurality of side panels foldably connected edge to edge and folded concertina fashion one relative to another. The side walls are preferably connected by partition walls which are foldably connected thereto, the gabion structure being adapted to be erected on site by pulling it apart by the end walls so that when it is moved from the flattened form to the erected condition the side walls unfold and define with the end walls and partition walls an elongated wall structure having a row of cavities to be filled with a fill material and of which each partition wall is common to the pair of cavities adjacent the partition wall.

Figure 1:
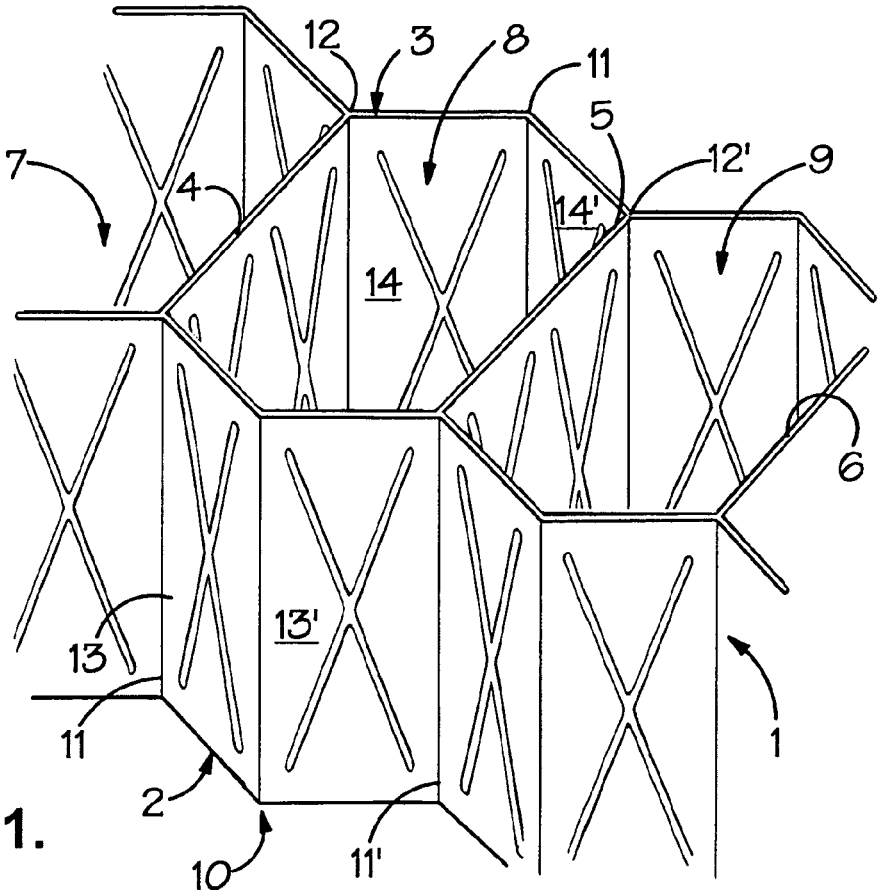
FIG. 1 shows a perspective view of a multi-compartmental gabion in accordance with the invention.
Figure 2:
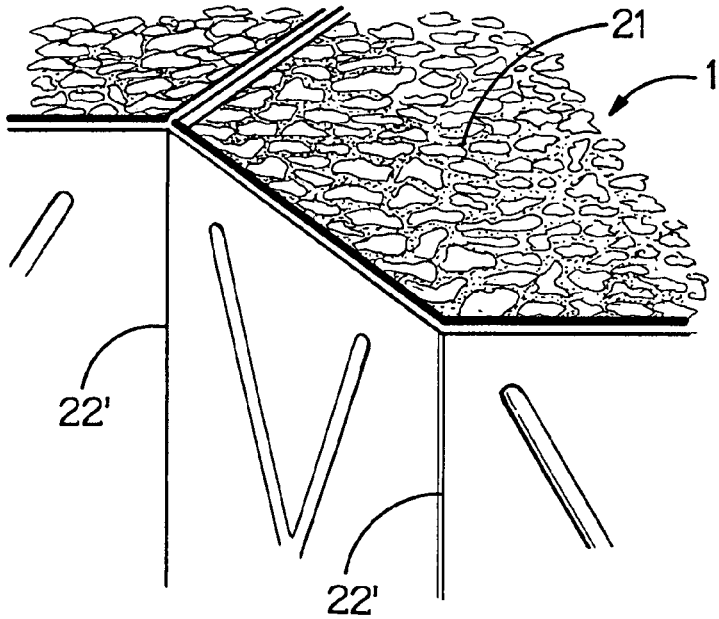
FIG. 2 shows the multi-compartmental gabion of FIG. 1 filled with a gabion fill material.

In the embodiments shown in FIGS. 1 and 2, each side wall section 10, 11 of multi-compartmental gabion 1 comprises two side wall element panels 13, 13', 14, 14', with resilient folds being provided between neighboring side wall element panels 13, 13' and between neighboring side wall element panels 14, 14'.

The resilient folds between partition walls 4, 5 (and other partition walls in the multi-compartmental gabion) and side walls 2, 3, and the resilient folds between neighboring side wall element panels 13, 13', 14 and 14', allow multi-compartmental gabion 1 to fold concertina-wise for flat-packing in transportation and storage. In the embodiments shown in FIGS. 1 and 2, the concertina-wise folding preferably operates so that the resilient folds between neighboring side wall element panels 13, 13', 14 and 14', move inwardly with respect to the longitudinal axis of multi-compartmental gabion 1 so that the width of the flat-packed gabion is at least approximately corresponding to the width of partition walls 4, 5 and 6.

The side wall element panels may be provided with texture, ribbing or other irregularities in order to maintain effective strength of the panel whilst minimizing its weight, and/or to provide decorative effect.

Referring to FIG. 2, multi-compartmental gabion 1 is shown filled with a gabion fill material 21. Fill material 21 may be selected from any suitable available material, as hereinbefore described. Rough earth and stones are shown as the fill material in FIG. 2. FIG. 2 also shows resilient folds 22, 22' between neighboring side walls of the gabion.

Figure 3:
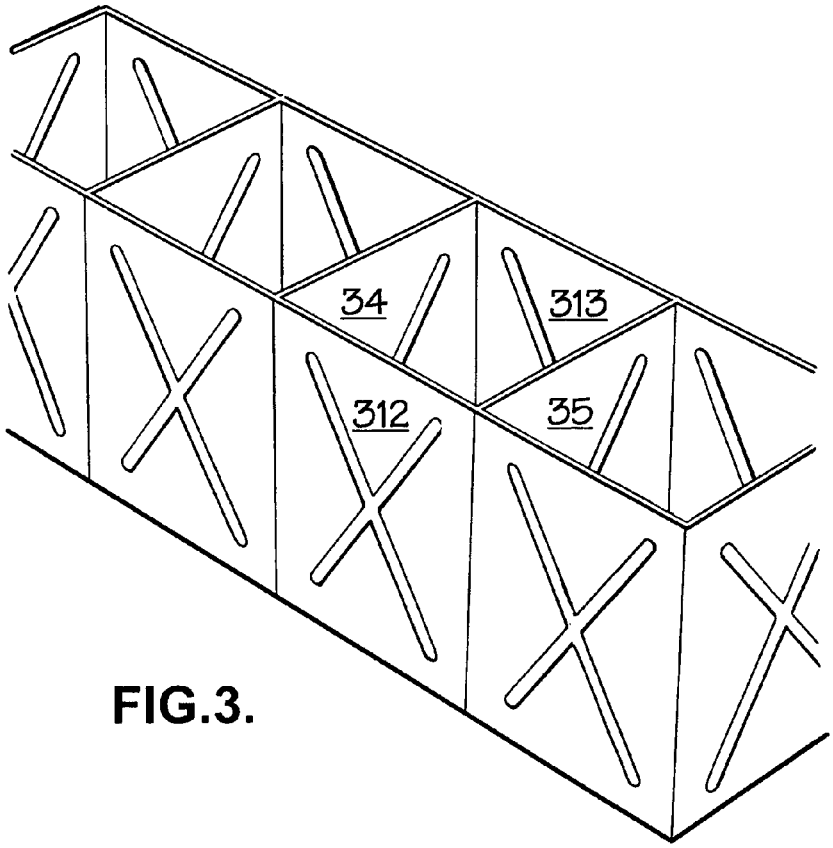
FIG. 3 shows a perspective view of a multi-compartmental gabion in accordance with a second embodiment of the invention.

Referring now to FIG. 3, there is shown a second embodiment of the multi-compartmental gabion, in which each individual compartment comprises a pair of partition walls 34, 35 and a pair of opposed side wall element panels 312, 313. Resilient folds therebetween allow the gabion to fold concertina-wise (first one way, and then the other) for flat packing and storage.

Figure 4:
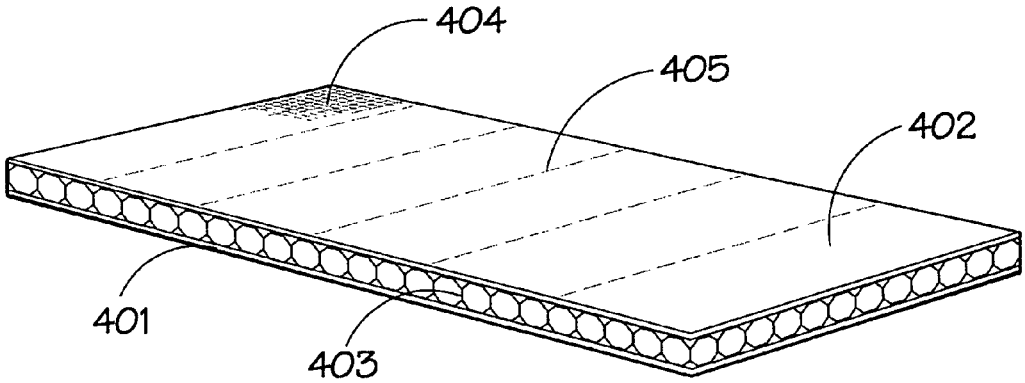
FIG. 4 shows a perspective view of a preferred wall material for use in the multi-compartmental gabion of the invention.

Referring now to FIG. 4, there is shown in schematic form a section of wall material comprising a three layer laminate structure. The outer layers 401 and 402 are formed from a woven polypropylene sheet, hot compacted to at least partially anneal the polypropylene fibres in the weave. Materials of this type, or precursors therefore, are described in WO9815397, WO9215440, WO2004103673, WO03045660, WO02102568, WO9726025 and WO02090082.

The inner layer 403 of the laminate structure comprises a honeycomb plastic, in this case polypropylene which has a honeycomb cellular structure throughout the plane of the laminate. Cellular materials generally, and honeycomb plastics materials in particular are well known in the art. Suitable cellular materials may be open or closed cell and may be formed from polyolefins, polyesters, polyurethanes, polycarbonates, polyamides, and combinations and copolymers thereof.

The woven nature of the outer sheets is schematically represented by reference numeral 404.

Putative fold lines 405 indicate where the sheet of FIG. 4 may be folded round and joined end to end to provide a hexagonal gabion compartment.

A skirt of geotextile material or similar may be affixed to the bottom edge of the sheet, but the skirt is not shown in FIG. 4.

The invention claimed is:

1. A gabion comprising at least one individual compartment for receiving, a fill material, each individual compartment of the gabion being bounded by at least one wall, the wall material forming at least one closed panel around the or each individual compartment effective for retaining the fill material in the or each compartment in use of the gabion, the wall material having flexibility to allow the gabion to be folded and/or rolled in a first, pre-deployment, configuration, wherein the pre-deployed gabion is restrained in its first configuration by a form of restraining means, the wall material having resilience such that when the gabion is released from its restraining means it unfolds and/or unrolls, at least partially assisted by the resilience of the wall material, from its first configuration to a second, deployment, configuration, the wall material having rigidity such that the gabion is erected and self supporting in said second configuration and able to receive in its individual compartment(s) the fill material.

2. The gabion according to claim 1 being a multi-compartmental gabion having at least two individual compartments.

3. The gabion according to claim 1 wherein the restraining means is selected from a form of clip, fastener, tie or container, or combinations of two or more thereof.

4. The gabion according to claim 1 folded concertina-fashion and compressed to minimize the gabion length in its first configuration.

5. The gabion according to claim 1 having a modulus of resilience in compression of less than −0.25.

6. The gabion according to claim 5 having a modulus of resilience in compression of less than −1.

7. The gabion according to claim 1 comprising side walls connected together at spaced intervals by partition walls, the side walls comprising at least one substantially closed side wall element panel, wherein the or each substantially closed side wall element is manufactured of a wall material having sufficient flexibility to allow the gabion to be folded and/or rolled in a first, pre-deployment configuration in which the pre-deployed gabion is restrained in its first configuration by a form of restraining means, the wall material having resilience such that when the gabion is released from its restraining means it unfolds and/or unrolls, at least partially assisted by the resilience of the wall material, from its first configuration to a second, deployment, configuration in which the gabion is erected, the wall material having rigidity such that the gabion is self supporting in said second configuration and able to receive in its individual compartments the fill material.

8. The gabion according to claim 1, wherein wall material comprises a laminate structure.

9. The gabion according to claim 8, wherein at least one layer of the laminate comprises a tear-resistant flexible material.

10. The gabion according to claim 9, wherein at least one other layer comprises a material having a cellular structure.

11. The gabion according to claim 10, wherein the cellular structure is a honeycomb structure.

12. The gabion according to claim 1, wherein the wall material comprises a polymeric sheet produced by hot compaction of melt spun fibres.

13. The gabion according to claim 12, wherein the melt spun fibres are woven in the sheet prior to hot compaction.

14. The gabion according to claim 12, wherein the polymeric sheet is stabilized with respect to ultraviolet radiation by the incorporation of fillers and/or UV absorbers to prevent the sheet becoming discoloured and/or brittle upon extended exposure to sunlight.

15. The gabion according to claim 1, wherein a skirt material is provided around the bottom edge of the or each individual compartment of the gabion, the skirt material being affixed to the wall material and inside the compartment.

16. A method for deploying the gabion of claim 1, effected by transporting the folded or rolled gabion to a deployment site, releasing the folded or rolled gabion from its form of restraining means, unfolding or unrolling the gabion wherein said unfolding or unrolling is at least partially assisted by the resilience of the wall material, causing the gabion to spring into or towards its erected configuration and filling each individual compartment of the gabion with a fill material.

17. A gabion comprising one or more compartments for receiving, a fill material, each compartment of the gabion being bounded by side walls connected together at spaced intervals by partition walls, the side walls comprising at least one substantially closed side wall element panel, wherein the or each substantially closed side wall element is manufactured of a wall material having sufficient flexibility to allow the gabion to be folded and/or rolled in a first, pre-deployment, configuration, wherein, the pre-deployed gabion is restrained in its first configuration by a form of restraining means, the wall material having resilience such that when the gabion is released from its restraining means it unfolds and/or unrolls, at least partially assisted by the resilience of the wall material, from its first configuration to a second, deployment, configuration, wherein the gabion is erected, the wall material having rigidity such that the gabion is self supporting in said second configuration and able to receive in its individual compartments the fill material.

18. The gabion of claim 17, wherein the partition walls comprise at least one substantially closed partition wall element panel manufactured of the same wall material used in the substantially closed side wall element.

19. The gabion according to claim 17, wherein the restraining means is selected from a form of clip, fastener, tie or container, or combinations of two or more thereof.

20. The gabion according to claim 17, wherein the folded gabion is folded concertina-fashion and compressed to minimize the gabion length.

21. A method for deploying a folded or rolled gabion, comprising:

transporting a folded or rolled gabion to a deployment site, a folded or rolled gabion is restrained by a restraining means;

releasing the restraining means, wherein the folded or rolled gabion unfolds or unrolls, at least partially assisted by the resilience of the wall material, into an erected configuration, the wall material having rigidity such that the gabion is self supporting in said erected configuration and able to receive in its individual compartments a fill material; and filling each individual compartment of the gabion with the fill material.

22. The method according to claim 21, wherein the gabion is a multi-compartmental gabion having at least two individual compartments.

23. The method according to claim 21, wherein the restraining means is selected from a form of clip, fastener, tie or container, or combinations of two or more thereof.

24. The method according to claim 21, wherein the folded or rolled gabion is folded concertina-fashion and compressed to minimize the gabion length.

25. The method according to claim 21, wherein the folded or rolled gabion has a modulus of resilience in compression of less than −0.25.

26. The method according to claim 21, wherein the folded or rolled gabion has a modulus of resilience in compression of less than −1.

27. The method according to claim 21, wherein the folded or rolled gabion comprises one or more side walls made from a wall material that comprises a laminate structure.

28. The method according to claim 27, wherein at least one layer of the laminate structure comprises a tear-resistant flexible material.

29. The method according to claim 21, wherein the folded or rolled gabion comprises one or more side walls made from a wall material that comprises a polymeric sheet produced by hot compaction of melt spun fibres.

30. The method according to claim 21, wherein the folded or rolled gabion comprises a skirt attached around the bottom edge and inside the compartment that prevents fill material from leaking out at the bottom of the gabion.

* * * * *